US006588607B2

(12) United States Patent
Smith et al.

(10) Patent No.: US 6,588,607 B2
(45) Date of Patent: Jul. 8, 2003

(54) FLIP POCKET MERCHANDISE DISPLAY SYSTEM

(75) Inventors: Ashley K. Smith, Richardson, TX (US); Jean K. Bergeson, 7329 Heathermore, Dallas, TX (US) 75248

(73) Assignee: Jean K. Bergeson, Dallas, TX (US)

( * ) Notice: Subject to any disclaimer, the term of this patent is extended or adjusted under 35 U.S.C. 154(b) by 0 days.

(21) Appl. No.: 10/044,437

(22) Filed: Jan. 11, 2002

(65) Prior Publication Data

US 2002/0096482 A1 Jul. 25, 2002

Related U.S. Application Data

(60) Provisional application No. 60/263,787, filed on Jan. 24, 2001.

(51) Int. Cl.[7] ..... A47H 1/00
(52) U.S. Cl. ..... 211/96
(58) Field of Search ..... 211/96, 168, 47, 211/48, 11, 10, 45, 53

(56) References Cited

U.S. PATENT DOCUMENTS

| | | | | | |
|---|---|---|---|---|---|
| 447,815 | A | | 3/1891 | Frercks | |
| 1,049,886 | A | | 1/1913 | Manson | |
| 1,240,611 | A | * | 9/1917 | Smith | 211/48 |
| 1,569,365 | A | | 1/1926 | Goldberg | |
| 1,791,616 | A | | 2/1931 | Duclos | |
| 1,879,679 | A | * | 9/1932 | Gover | 211/106 |
| 2,194,191 | A | * | 3/1940 | Wolf | 211/168 |
| 2,804,212 | A | * | 8/1957 | Spitzig | 211/169 |
| 3,661,273 | A | | 5/1972 | Crosslen | |
| 4,095,360 | A | | 6/1978 | Dinan et al. | |
| 4,102,069 | A | | 7/1978 | Eckert | |
| 4,103,778 | A | * | 8/1978 | Bradshaw | 211/102 |
| 4,482,062 | A | | 11/1984 | Huntsberry | |
| 4,526,335 | A | | 7/1985 | Garfinkle | |
| 5,038,946 | A | * | 8/1991 | Tenser et al. | 206/554 |
| 5,346,166 | A | | 9/1994 | Valiulis | |
| 5,348,167 | A | | 9/1994 | Jensen | |
| 5,386,916 | A | | 2/1995 | Valiulis | |
| 5,415,370 | A | | 5/1995 | Valiulis | |
| 6,070,747 | A | | 6/2000 | Shea | |
| 6,202,866 | B1 | | 3/2001 | Shea | |
| 6,286,690 | B1 | | 9/2001 | Thalenfeld | |

* cited by examiner

*Primary Examiner*—Alvin Chin-Shue
*Assistant Examiner*—Sarah Purol
(74) *Attorney, Agent, or Firm*—Dennis T. Griggs

(57) ABSTRACT

A hanging pocket product display system includes an elongated base member, a hanger and a pocket member. The elongated base member has holes formed therein along at least a portion of the base member. The hanger has a first end, a central portion and a second end. The first end of the hanger is adapted to be removably inserted into at least one of the holes in the base member, such that the first end of the hanger can pivot within the at least one hole, such that the hanger can pivot about the first hanger end relative to the base member, and such that the second hanger end traverses along an arc when the hanger pivots about the first hanger end. The pocket member comprises a pocket formed thereon, and the pocket member is adapted to hang on the hanger.

31 Claims, 6 Drawing Sheets

FLIP POCKET MERCHANDISE DISPLAY SYSTEM

CROSS-REFERENCE TO RELATED APPLICATION

This application claims the benefit under 35 U.S.C. §119 of commonly owned U.S. Provisional Application Ser. No. 60/263,787 entitled FLIP POCKET MERCHANDISING SYSTEM filed on Jan. 24, 2001 which is also hereby incorporated by reference.

BACKGROUND OF THE INVENTION

This invention relates generally to merchandise or product display systems. Shelving and hanger structures and related display units for displaying products or merchandise are commonly seen in most any type of store or commercial establishment that sells and/or displays goods. The desire of most all merchants is to maximize the available shelf or display capacity within the limited confines of a store or show room. Vertical extending pegboard surfaces, slat wall or other standard wall fixtures are commonly known and are often quite effective for displaying large numbers of small items on hooks, hangers, strips, clips, and/or shelves.

The display of generally planar goods, such as die cuts, cards, art templates, storage media discs, documents, pictures, and photos, can consume a lot of space if not organized properly. Or in some cases when highly organized or stacked, the display of generally planar goods may hinder the view of all the products or make it more difficult or cumbersome to browse through the items. Such generally planar goods are thus often difficult to display in a small amount of space. Hence, there is a need for a space efficient display system that also provides adequate display and visibility of the products as well as ease of browsing through multiple different products being displayed.

BRIEF SUMMARY OF THE INVENTION

The problems and needs outlined above are addressed by the present invention. In accordance with one aspect of the present invention, a display system is provided. The display system comprises an elongated base member, a hanger, and a pocket member. The elongated base member has index holes formed therein along at least a portion of the base member. The hanger has a first end, a central portion, and a second end. The first end of the hanger is adapted to be removably inserted into at least one of the index holes in the base member, such that the first end of the hanger can pivot within the at least one hole, such that the hanger can pivot about the first hanger end relative to the base member, and such that the second hanger end traverses along an arc when the hanger pivots about the first hanger end. The pocket member comprises a pocket formed thereon, and the pocket member is adapted to hang on the hanger.

The holes may be substantially uniformly spaced apart. The base member may be a hollow member having a first side, and a second side opposite of the first side, wherein some of the holes are through the first side and aligned with corresponding holes through the second side. The base member may be substantially solid, wherein at least some of the holes do not extend entirely through the base member. The base member may comprise square tubing. The base member may be a single piece, or the base member may have an adjustable length by comprising two separate elongated pieces, wherein the first elongated piece is adapted to telescopically slide in the second elongated piece. The first and second elongated pieces each may have the holes formed therein, wherein the hanger can prevent the first elongated piece from sliding relative the second elongated piece when the first end of the hanger extends through one of the holes formed in the second elongated piece and through another of the holes that is formed in the first elongated piece. A set screw may be fastened to the second elongated piece to prevent the second elongated piece from sliding relative to the first elongated piece when the set screw engages the first elongated piece.

The hanger may be formed from metal wire or molded from plastic material, for example. The hanger may be generally L-shaped. The second end of the hanger may be bent upward to form an obtuse angle between the second hanger end and the central hanger portion. The first end of the hanger may be bent downward to form an angle between the first hanger end and the central hanger portion. The pocket member may further comprise a second pocket formed thereon. An upper portion of the pocket member may form an elongated and hollow tube region adapted to receive the hanger therein when the pocket member hangs on the hanger. The pocket may be on a first side and at a first end of the pocket member, and the pocket member may further comprise a second pocket formed on the first side and at a second end of the pocket member, so that the pocket member can be draped over and saddling the hanger when operably installed, and the pocket member can be generally U-shaped with the pockets facing opposite directions.

The pockets each may be adapted to hold at least one sheet of paper, such as paper that is rectangular shaped having the dimensions of about 8.5 inches by about 11 inches or having the dimensions of about 12 inches by about 12 inches, for example. The pocket may be at least partly made from transparent material so that when an object is in the pocket, the object can be seen through the pocket. A second pocket may be formed on the pocket member, wherein the pockets are formed on opposite sides of the pocket member. The pocket member may further comprise two or more additional pockets formed thereon. An attachment hook member may extend from the base member, wherein the attachment hook member is adapted to be removably latched onto a display fixture. Attachment hook members may extend from one side of the base member, wherein the attachment hook members are adapted to be removably latched onto at least one type of standard display fixture. A tip cover may be added that is adapted to fit over at least part of the second hanger end. Also, a tip cover may be added that is adapted to fit over at least part of the first hanger end when the at least part of the first hanger end extends through and outside of the base member.

In accordance with another aspect of the present invention, a product display system is provided. The product display system comprises an elongated base member, attachment hooks, a generally L-shaped hanger, and a pocket member. The elongated base member has substantially evenly spaced holes formed therein along a top side of the base member. The attachment hooks extend from the base member. The attachment hooks are adapted to removably latch onto a display fixture to secure the base member to the display fixture. The generally L-shaped hanger has a first end, a central portion, and a second end. The first hanger end is bent down relative to the central hanger portion to form an angle between the first hanger end and the central hanger portion between about 45 degrees and about 135 degrees. The first hanger end is adapted to be removably inserted into at least one of the holes, such that the first hanger end can pivot while in the at least one hole, such that the hanger can pivot about the first hanger end relative to the base member, and such that the second hanger end traverses along an arc when the hanger pivots about the first hanger end. The pocket member comprises a pocket formed thereon. The pocket member is adapted to hang on the hanger along at least part of the central hanger portion.

In accordance with yet another aspect of the present invention, a product display system is provided, which comprises a first elongated base member, a second hollow elongated base member, a first attachment hook, a second attachment hook, a generally L-shaped hanger, and a pocket member. The first elongated base member has a first plurality of substantially evenly spaced holes formed therein along a top side of the first base member. The second elongated base member has a second plurality of substantially evenly spaced holes formed therein along a top side of the second base member. The first base member has an outside shape and dimensions such that the first base member can telescopically slide at least partially into the second base member. The first plurality of holes is adapted to be aligned with the second plurality of holes at two or more different positions. The first attachment hook extends from the first base member. The second attachment hook extends from the second base member. The attachment hooks are adapted to removably latch onto at least one type of standard display fixture to secure the base members to the display fixture.

The generally L-shaped hanger has a first end, a central portion, and a second end. The first hanger end is bent down relative to the central hanger portion to form an angle between the first hanger end and the central hanger portion between about 45 degrees and about 135 degrees. The first hanger end is adapted to be removably inserted into at least one of the second plurality of holes and into at least one of the first plurality of holes at the same time, such that the hanger prevents the first base member from sliding relative the second base member when the first hanger end is operably installed. By this arrangement, the first hanger end can pivot while in the holes, such that the hanger can pivot about the first hanger end relative to the base members, and such that the second hanger end traverses along an arc when the hanger pivots about the first hanger end. The pocket member includes a pocket formed thereon. The pocket member is adapted to hang on the hanger along at least part of the central hanger portion.

BRIEF DESCRIPTION OF THE DRAWINGS

The accompanying drawings are incorporated into and form a part of this specification to illustrate embodiments of the present invention. Various advantages and features of the invention will be understood from the following detailed description taken with reference to the attached drawing figures in which.

DETAILED DESCRIPTION OF THE INVENTION

Figure 1:
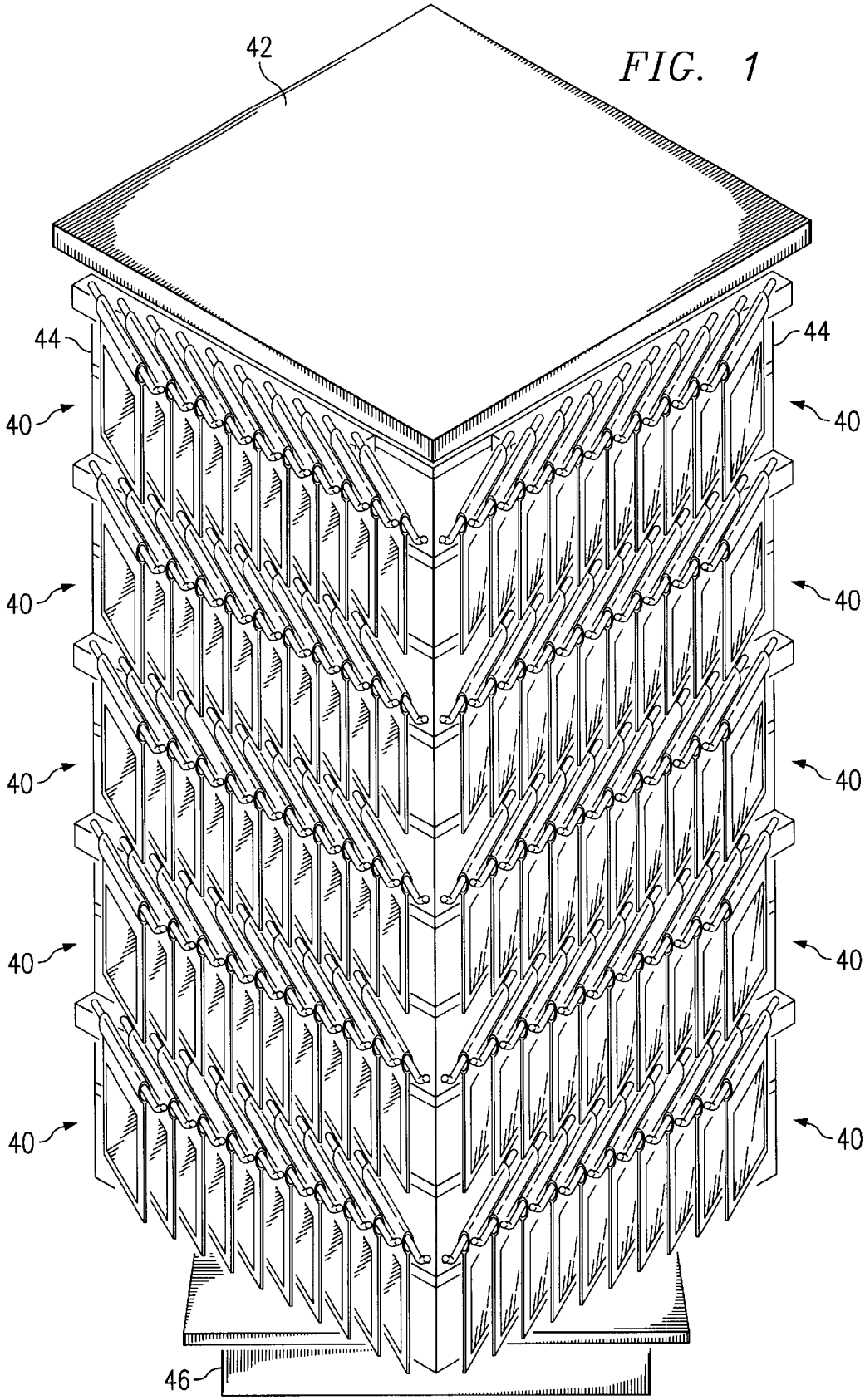
FIG. 1 is a front perspective view showing a display rack having twenty display systems thereon, each display system being a preferred embodiment of the present invention.

Embodiments of the invention will now be described with reference to various examples of how the invention can best be made and used. Like reference numerals are used throughout the description and several views of the embodiments to indicate like or corresponding parts.

As used herein, the term "end" is used to generically refer to or call out a general side, portion, section, region, tip, and/or location of or along a component. For example, a part coupled to a first "end" of a component may be located at any chosen place along or on the component designated as the first end, which may or may not encompass a most distal edge or tip of the component. As another example, consider a hypothetical shaft divided into two regions designated as a first end and a second end, and having a part coupled to the first end (and not coupled to the second end). The part may be located at a most distal tip of the shaft at the first end, or at any other location along the shaft at the first end. In this shaft example, the first end of the shaft is a first region or section of or along the shaft extending from a most distal tip of the shaft to the location along the shaft where the second end begins. Likewise, the second end of the shaft is a second region or section of the shaft extending from the other most distal tip of the shaft to the location along the shaft where the first end begins. Therefore, if someone grasps the first end of the shaft, he or she is not necessarily holding the shaft at one of the most distal tips, but rather on one of the sides or portions of the shaft arbitrarily defined as the first end in the context.

A hanging product display system 40 in accordance with a preferred embodiment of the present invention is illustrated in FIGS. 1–4, and 8, 9A, 9B, 10A and 10B. The display system 40 is designed for holding and displaying numerous products in a space efficient manner. FIG. 1 shows one possible configuration or use (among many) of the display system 40. In FIG. 1, die cut patterns are stored and displayed in the pockets of the numerous pocket members. Because the pockets are transparent vinyl, the products can be viewed without removing them from the pockets. A pocket may contain a number of the same product, and the products stored and displayed in the pockets can vary. Hence, the display system 40 also provides a way to organize different sets of products. When a customer, for example, wants to browse through the different products, the customer can flip through the pocket members because the pocket members are designed to pivot or swivel. Thus, the customer can browse through the different products much like someone would turn the pages of a printed paper catalog. When an item is desired, the customer can simply remove one (or more) of the products from its pocket. Furthermore, the products within the pockets are protected from damage during handling.

Figure 2:
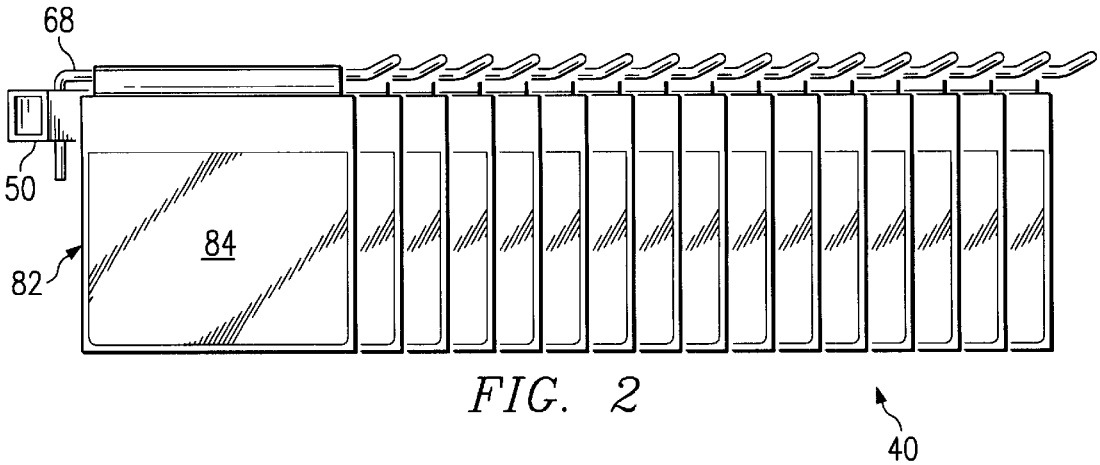
FIG. 2 is a front perspective view of a display system of the preferred embodiment.

FIG. 2 illustrates the display system 40 of the preferred embodiment alone, i.e., not installed on a display fixture. Whereas in FIG. 1, there are twenty of the display systems 40 (only ten shown in FIG. 1—view of other ten are hidden on the back side) latched onto a generally cube shaped display fixture 42 having slat boards 44 and rotating base connection 46.

Figure 3:
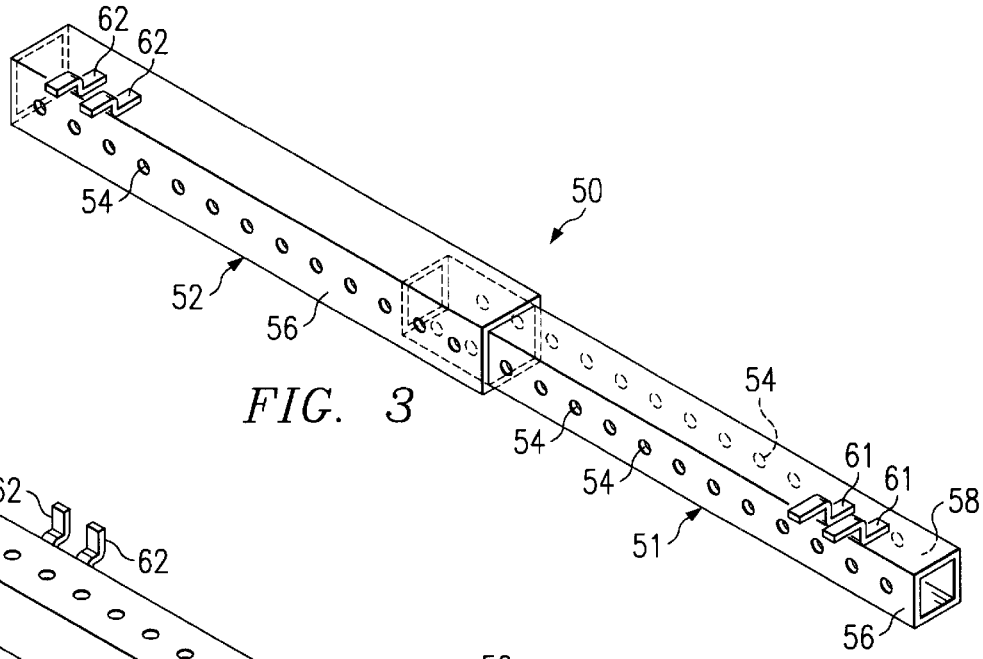
FIG. 3 is a top perspective view of a base member of the preferred embodiment.
Figure 4:
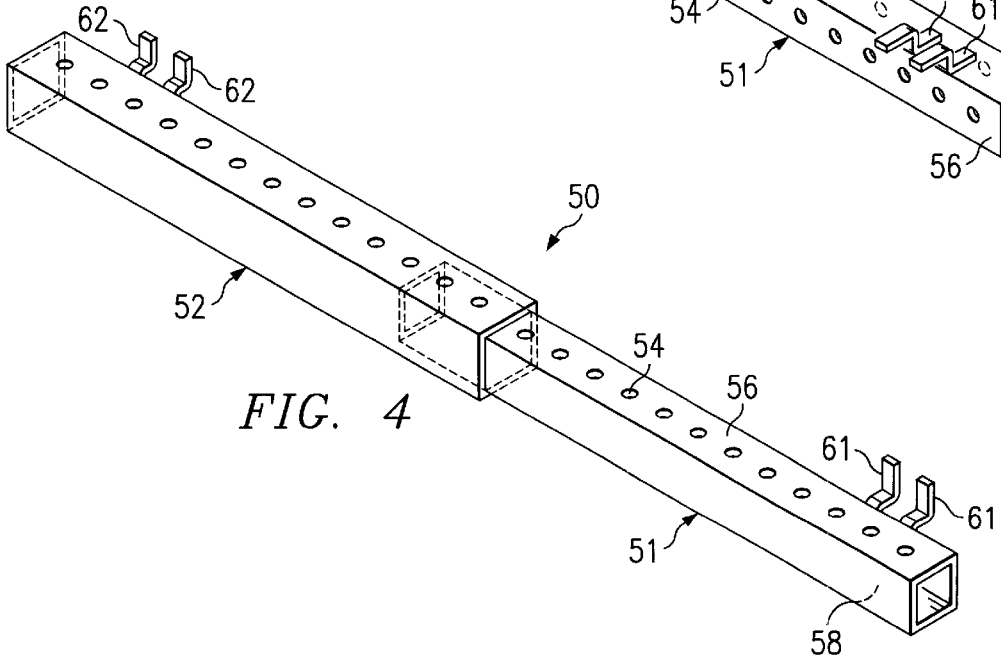
FIG. 4 is a front perspective view of a base member of the preferred embodiment.

FIG. 3 shows a top perspective view and FIG. 4 shows a front perspective view of an elongated base member 50 for the display system 40 of FIG. 2. The base member 50 of the preferred embodiment comprises two separable parts: a first base member portion 51 and a second base member portion 52. Both parts 51, 52 of the base member 50 are hollow square tubing made from steel. However, other shapes of tubing (e.g., round, rectangular) may be used in alternative. Also, the base member 50 may be made from other materials (e.g., aluminum, plastic, chromed steel, wood) or combinations of materials, for example. The outer shape and dimensions of the first base member portion 51 are chosen so that the first base member portion 51 can telescopically slide in the second base member portion 52, as shown in FIGS. 3 and 4. The first base member portion 51 may be hollow, solid, or partially hollow. The second base member portion 52 will likely be entirely hollow, but there may be parts of the second base member portion 52 that are solid or filled.

As best shown in FIG. 3, each base member portion 51, 52 has a plurality of index holes 54 formed therein along the top side 56 and along the bottom side 58. The index holes 54 on the bottom side 58 are aligned with the index holes 54 on the top side 56 such that a straight wire or pin may be inserted into a hole 54 in the top side 56 and through a corresponding hole 54 in the bottom side 58. The holes 54 are uniformly spaced apart, and the holes 54 in the first base member portion 51 are spaced apart by about the same amount as the holes 54 in the second base member portion 52. Hence, when the first base member portion 51 is slid into the second base member portion 52, the holes 54 of the first base member portion 51 can be aligned with the holes 54 of the second base member portion 52. Because the two base member portions 51, 52 slidably engage, the holes 54 need not be uniformly spaced to align a hole 54 in the first base portion 51 with a hole 54 in the second base portion 52. In other embodiments of the present invention, the holes 54 may not extend entirely through the base member 50 (e.g., a solid portion of a base member having one or more holes that do not extend entirely through the base member).

The first base member portion 51 has a first attachment hook 61 extending therefrom. Likewise, the second base member portion 52 has a second attachment hook 62 extending therefrom. The attachment hooks 61, 62 provide a way to removably latch the base member 50 onto a standard display fixture. The attachment hooks 61, 62 of the preferred embodiment are designed so that the attachment hooks 61, 62 can latch onto more than one type of standard display fixture. Some of the commonly used standard display fixtures include, but are not necessarily limited to: a pegboard, a slat board, and a wire grid wall fixture. Specifically, the attachment hooks 61, 62 of the preferred embodiment can be latched onto a standard pegboard, a standard slat board, or affixed otherwise to a wire grid wall fixture.

Figure 5:
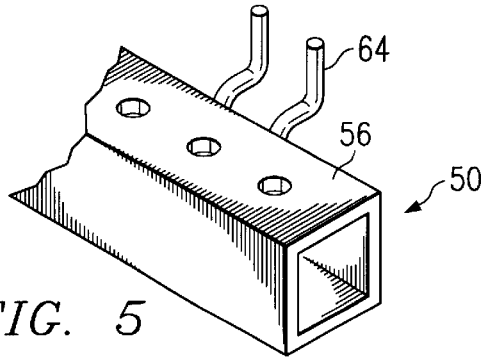
FIGS. 5 and 6 are each a cut away portion of a perspective view showing a base member in accordance with other embodiments of the present invention.
Figure 6:
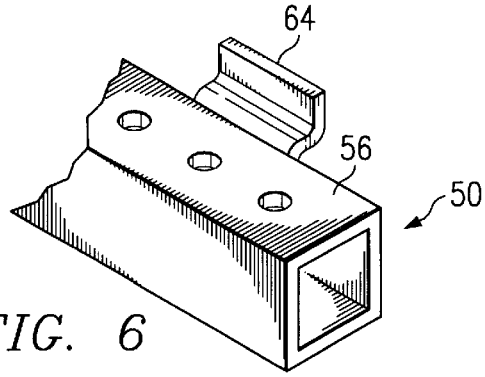
Figure 7:
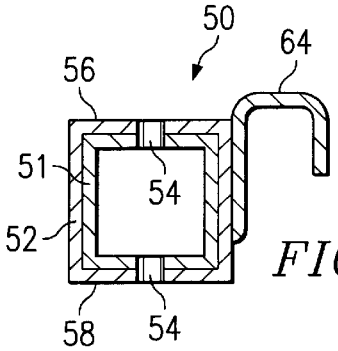
FIG. 7 is a side view of a base member in accordance with another embodiment of the present invention.

However, the design of the attachment hooks 61, 62 may vary, depending on the application. FIGS. 5–7 show three other attachment hook designs 64 (among many possibilities) that may be alternatively substituted into an embodiment of the present invention. The attachment hook 64 shown in FIG. 5 has curved rods with a round cross-section, which may be used in a pegboard having round holes. The attachment hook 64 of FIG. 6 is a curved plate with a rectangular cross-section, which may be used in a slat board having slots formed therein. The attachment hook 64 of FIG. 7 has rods that curve downward, which may be used to latch onto a wire grid fixture or onto a horizontally extending beam.

Figure 8:
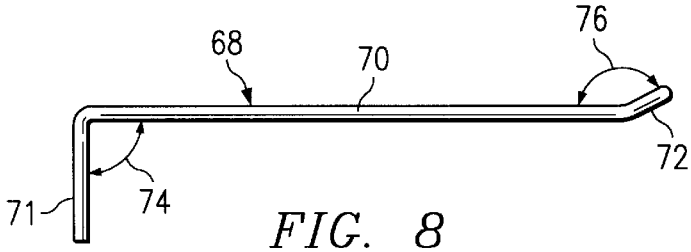
FIG. 8 is a side view of a hanger of the preferred embodiment.

FIG. 8 shows a hanger 68 for the preferred embodiment. The hanger 68 of the preferred embodiment is made from metal wire, but a hanger in accordance with the present invention may be made from other materials (e.g., plastic, wood) or from a combination of materials (e.g., rubber coated metal wire, enamel coated metal wire, polymer coated nylon thread), for example. The hanger 68 has a central portion 70, a first end 71, and a second end 72. The hanger 68 of FIG. 7 is generally L-shaped because the first hanger end 71 is bent downward relative to the central hanger portion 70 to form an angle 74 of about 90 degrees between the first hanger end 71 and the central hanger portion 70. The bend between the first hanger end 71 and the central hanger portion 70 may vary. For example, the angle 74 between the first hanger end 71 and the central hanger portion 70 may be obtuse or acute.

For most applications, it will be desirable for the angle 74 between the first hanger end 71 and the central hanger portion 70 to be between about 45 degrees and about 135 degrees. Also, the bend between the first hanger end 71 and the central hanger portion 70 may have other shapes (not shown), including, but not necessarily limited to: rounded, generally question-mark-shaped, or generally S-shaped. Furthermore, the cross-section or diameter of the hangers 68 may vary according the amount of weight (e.g., weight of the products to be displayed in the pockets) that the hanger 68 needs to support.

The length of the first hanger end 71, and of the central hanger portion 70, each may vary also. The central hanger portion 70 of the preferred embodiment is straight, but the shape of the central portion 70 may vary as well. For example, the central hanger portion 70 may have a wavy shape (not shown). Also, the central hanger portion 70 may have a rough, coated, or knurled surface (not shown) for gripping the pocket member when it is installed thereon.

The second end 72 of the hanger 68 is bent upward relative to the central hanger portion 70 to form an obtuse angle 76 between the second hanger end 72 and the central hanger portion 70. In other embodiments, the second hanger end 72 may not be bent at all (not shown), or on the other hand, the second hanger end 72 may be bent more to form a 90-degree angle or an acute angle (not shown).

Figure 9A:
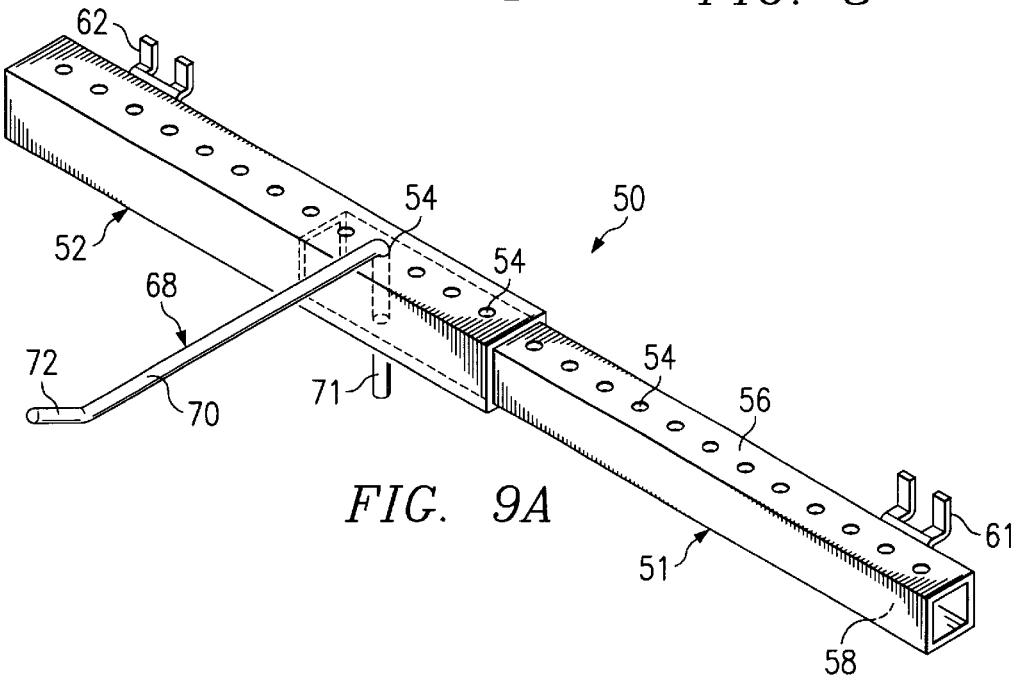
FIG. 9A is a perspective view of the base member and the hanger of the preferred embodiment.

FIG. 9A is a perspective view of the base member 50 of FIGS. 3 and 4 combined with the hanger 68 of FIG. 8 to illustrate how the hanger 68 serves another purpose—preventing the first base member portion 51 from sliding relative to the second base member portion 52. The base member 50 of the preferred embodiment has an adjustable length. Without a hanger installed in either of the base member portions 51, 52, the first base member portion 51 is free to slide into and/or out of the second base member portion 52. To make the base member 50 shorter (e.g., 18 inches long), the first base member portion 51 may be slid into the second base member portion 52 to a position where a hole or holes 54 in the first base member portion 51 align with a hole or holes 54 of the second base member portion 52.

Then when the desired length of the base member 50 is established and while the holes 54 are aligned, the hanger 68 can be inserted into a hole 54 in the first base member portion 51 at a location where it will also extend through a hole 54 in the second base member portion 52, which will prevent the portions 51, 52 from sliding relative to one another. Likewise, to make the base member 50 longer (e.g., 30 inches long), which would allow for more hangers 68 to be installed, the first base member portion 51 may be slid out of the second base member portion 52 to a position where the holes 54 are aligned. The position shown in FIG. 9A is somewhere in between the shortest length and the longest length. In an alternative embodiment (not shown), there may be a set screw fastened to the second base member portion 52 that can hinder or prevent the first base member portion 51 from sliding relative to the second base member portion 52 when the set screw engages the first base member portion 51.

Figure 9B:
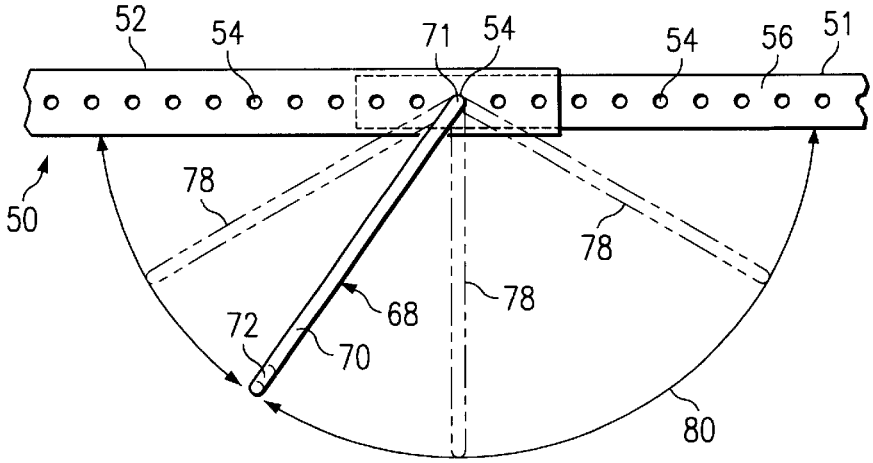
FIG. 9B is a cut-away top view of the base member and the hanger of the preferred embodiment.

For illustration purposes, FIGS. 9A and 9B are shown with only one hanger 68 inserted into the base member 50. However, as shown in FIG. 2, many hangers 68 may be inserted into the base member 50 to expand the capacity of the display system 40. FIG. 9B is a top view of the assembly shown in FIG. 9A. When a hanger 68 is inserted into a hole 54 of the base member 50, it is free to pivot within the hole 54, as illustrated in FIG. 9B by the phantom line showings of the hanger 78 in different positions. Also shown in FIG. 9B, the kinematics of the coupling between the hanger 68 and the base member 50 are configured so that the hanger 68 can pivot about the first hanger end 71 and the second hanger end 72 traverses along an arc 80 when the hanger 68 pivots about the first hanger end 71.

Figure 10A:
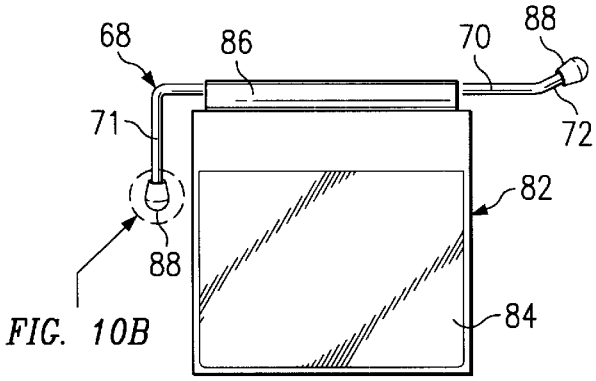
FIG. 10A is a side view of the hanger and a pocket member of the preferred embodiment.

FIG. 10A is a side view of a pocket member 82 hanging on the hanger 68 of FIG. 8. The pocket member 68 of the preferred embodiment is made from one ply of white sheet vinyl. On each side of the pocket member 82, there is a piece of transparent sheet vinyl bonded along three of its sides to the white vinyl portion to form a pocket 84 on the pocket member 82. Hence, the pocket member 82 of FIG. 10A has two transparent pockets 84, one on each side. However, there are many other possible pocket configurations and variations of the pocket member size.

Figure 11:
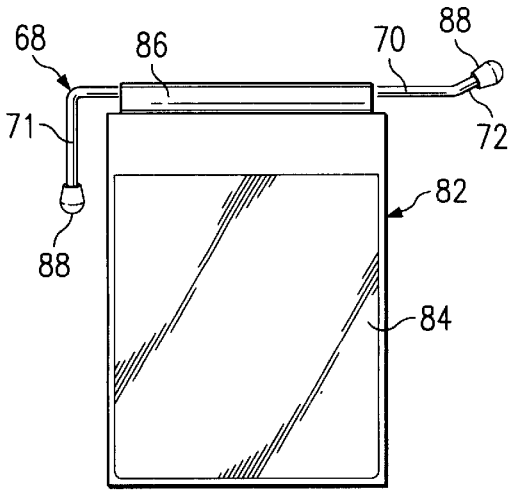
FIG. 11 is aside view of the hanger and a pocket member in accordance with another embodiment of the present invention.
Figure 12:
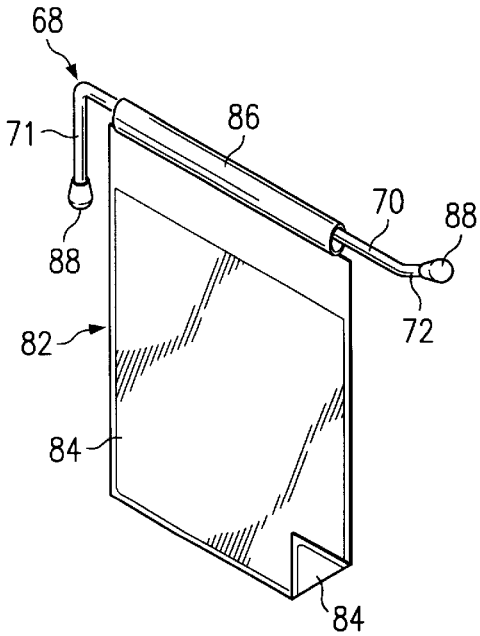
FIG. 12 is a perspective view of the hanger and pocket member shown in FIG. 11.
Figure 13:
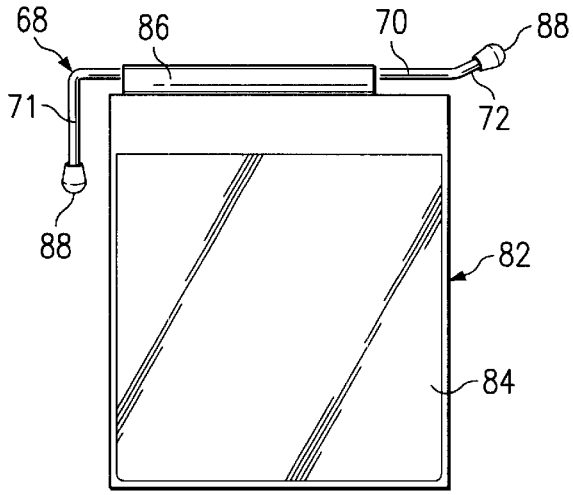
FIG. 13 is aside view of the hanger and a pocket member in accordance with yet another embodiment of the present invention.
Figure 14:
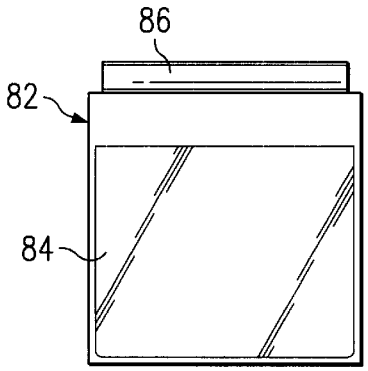
FIGS. 14–17 each is a side view of pocket member in accordance with other embodiments of the present invention.
Figure 15:
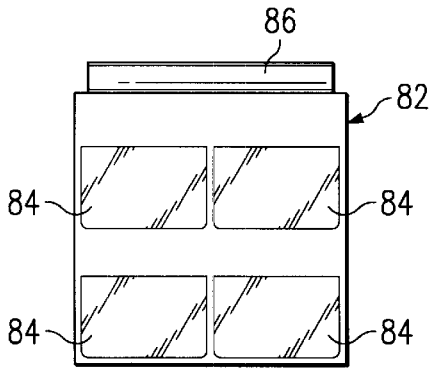
Figure 16:
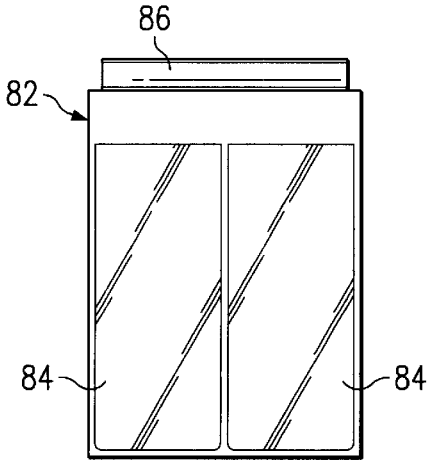
Figure 17:
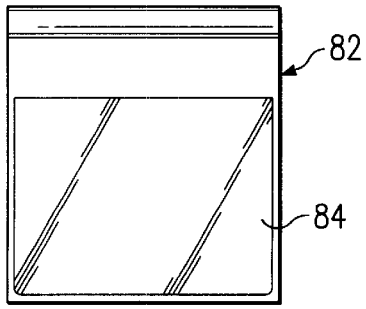

FIG. 11 is a side view and FIG. 12 is a perspective view of a pocket member 82 in accordance with another embodiment of the present invention, which is sized so that it can hold at least one sheet of letter sized paper (about 8.5 inches×about 11 inches). Thus, the pocket member 82 of FIGS. 11 and 12 may be used to hold a stack of paper sheets. As best shown in FIG. 12, an upper portion of the pocket member 82 is bonded to form an elongated and hollow tube region 86 that is adapted to receive the hanger 68 therein when the pocket member 82 hangs on the hanger 68. Also, FIG. 12 shows a corner flipped up to illustrate that there is a pocket 84 on each side.

FIGS. 13–17 show some other pocket members 82 in accordance with other embodiments of the present invention. For example, the pocket member 82 of FIG. 13 has a pocket 84 that is adapted to hold one or more sheets of paper having a square dimension of about 12 inches by about 12 inches. But, the present invention may be adapted to hold numerous other sizes of paper. Note that the pocket member 82 shown in FIG. 15 has four pockets 84 on each side and the pocket member 82 shown in FIG. 16 has two elongated pocket 84 on each side. Hence, the number of pockets 84 placed on one or both sides of the pocket member 82 may vary also.

Figure 10B:
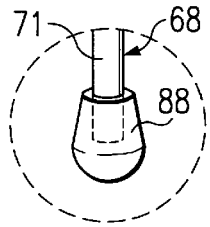
FIG. 10B is an enlarged view of a portion of FIG. 10A.

A tip cover 88 may be placed over the tip of the first hanger end 71 and/or over the tip of the second hanger end 72, as shown in FIG. 10A. FIG. 10B is an enlarged view of the tip cover 88 on the tip of the first hanger end 71 in the preferred embodiment. The tip covers 88 may be made from a variety of materials, including but not necessarily limited to: rubber, plastic, nylon, or any combination thereof. The tip cover 88 on the tip of the second hanger end 72 may help prevent the pocket member 82 from being slid off of the hanger 68 during use. Similarly, the tip cover 88 on the tip of the first hanger end 71 may help prevent the hanger 68 from being removed from the base member 50. Also, if the tip of the second hanger end 72 is sharp or has a sharp edge (e.g., from when the hanger 68 was cut during production), the tip cover 88 may prevent a person from catching, snagging, or tearing the person's clothes when the person brushes against the display system 40. Hence, the tip covers 88 can be safety features. The tip may also serve as a pricing guide. Different color tips may be used to differentiate prices.

Figure 18:
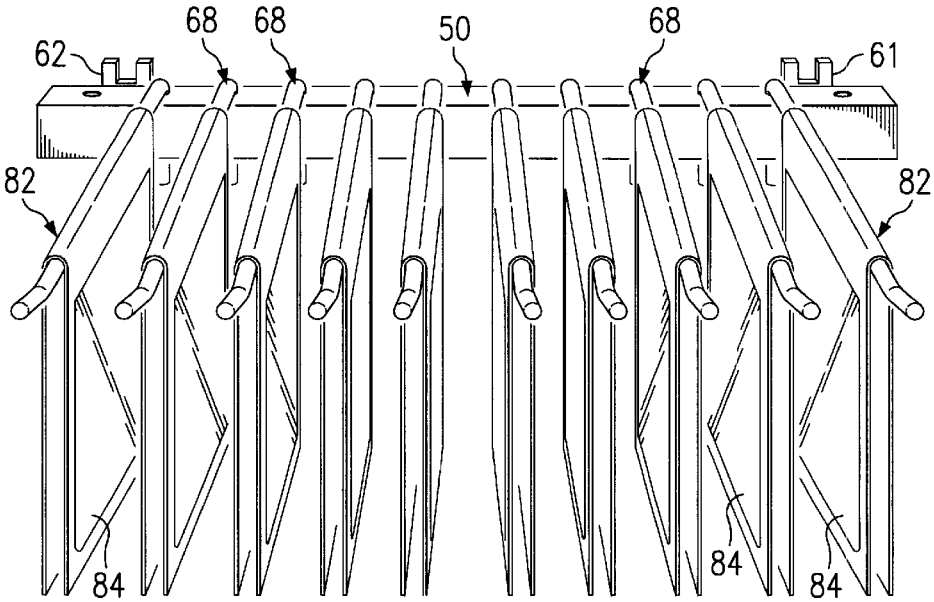
FIG. 18 is a front view of a display system in accordance with still another embodiment of the present invention.
Figure 19:
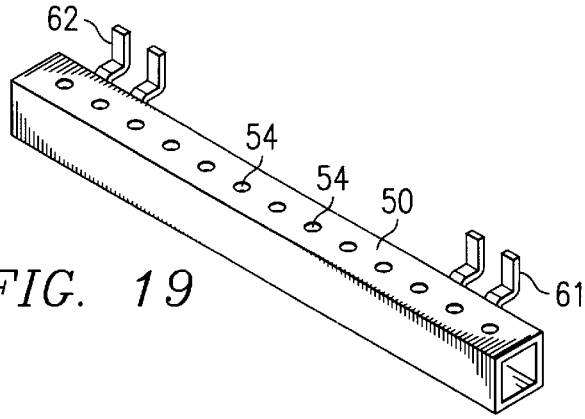
FIG. 19 is perspective view of a base member of the embodiment shown in FIG. 18.
Figure 20:
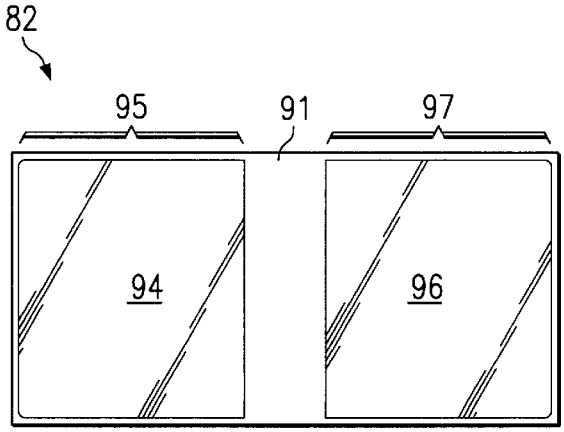
FIG. 20 is a top view of a first side of an unfolded pocket member of the embodiment shown in FIG. 18.
Figure 21:
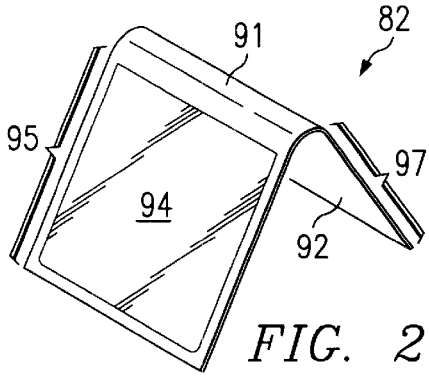
FIG. 21 is a perspective view of the pocket member of FIG. 20.

FIGS. 18–21 show yet another embodiment of the present invention. FIG. 19 shows the base member 50 alone. Note that the base member 50 in this embodiment is a single piece and thus, it is not adjustable in length as in the preferred embodiment described above. Note in FIG. 18 that each pocket member 82 is draped over and saddling its respective hanger 68, and the pocket members 82 are each generally U-shaped in this draped configuration. FIGS. 20 and 21 show one of the pocket members 82 of FIG. 18 alone. In FIG. 20, a first side 91 of the pocket member 82 is shown in an extended, flat configuration (not operably installed on a hanger 68), and FIG. 21 is a perspective view of the pocket member 82 in a partially folded configuration (also not operably installed on a hanger 68).

The pocket member 82 of FIGS. 20 and 21 has a first pocket 94 at a first end 95 of the pocket member 82 on the first side 91, and the pocket member 82 has a second pocket 96 at a second end 97 of the pocket member 82 on the first side 91. As best shown in FIG. 21, the second side 92 of the pocket member 82 does not have a pocket because the second side 92 is not readily accessible when the pocket member 82 is operably installed, although it may have a pocket 84 thereon if desired. Thus, when the pocket members 82 are operably installed on the hangers 68, as shown in FIG. 18, the pockets 94, 96 for a given pocket member 82 face opposite directions.

Although the invention has been described with reference to certain exemplary arrangements, it is to be understood that the forms of the invention shown and described are to be treated as embodiments of the present invention. In light of the description herein, various changes, substitutions, and modifications may be realized without departing from the spirit and scope of the invention as defined by the appended claims.

We claim:

1. A merchandise display system for attachment to a display support structure of the type that may be found in retail stores comprising:

an elongated base member that is adjustable in the width dimension, the elongated base member having holes formed therein along at least a portion of the base member;

the base member including first and second base sections movably coupled together for extension and retraction relative to each other, each base section having multiple index holes and the index holes of one base member being alignable with the index holes of the other at various width positions, and are sized to receive an end portion of a display support arm, so that the display support arm can swivel side-to-side, and which simultaneously locks the adjustable sections of the base member at a fixed width dimension;

one or more hangers coupled to the base member for swivel movement, permitting the one or more support arms to be "flipped" from side-to-side, each hanger having a first end portion, a central portion, and a second end portion, the first end portion of the hanger being adapted to removably insert into at least one of the holes in the base member, such that the first end portion of the hanger can pivot within the at least one hole, such that the hanger can pivot about the first hanger end portion relative to the base member, and such that the second hanger end portion traverses along an arc when the hanger pivots about the first hanger end portion; and a pocket member comprising a pocket formed thereon, the pocket member depending from the hanger.

2. The merchandise display system of claim 1, wherein the holes are substantially uniformly spaced apart.

3. The merchandise display system of claim 1, wherein the base member is a hollow member having a first side and having a second side opposite of the first side, and wherein some of the holes are through the first side and aligned with corresponding holes through the second side.

4. The merchandise display system of claim 1, wherein the base member is substantially solid and wherein at least some of the holes do not extend entirely through the base member.

5. The merchandise display system of claim 1, wherein the base member comprises square tubing.

6. The merchandise display system of claim 1, wherein the base member is a single piece.

7. The merchandise display system of claim 1, wherein the base member comprising two separate elongated pieces, the first elongated piece being coupled in slidable engagement with the second elongated piece.

8. The merchandise display system of claim 7, wherein the first and second elongated pieces each have the holes formed therein, wherein the hanger can prevent the first elongated piece from sliding relative the second elongated piece when the first end of the hanger extends through one of the holes formed in the second elongated piece and through another of the holes that is formed in the first elongated piece.

9. The merchandise display system of claim 7, wherein a set screw fastened to the second elongated piece prevents the second elongated piece from sliding relative to the first elongated piece when the set screw engages the first elongated piece.

10. The merchandise display system of claim 1, wherein the hanger is formed from metal wire.

11. The merchandise display system of claim 1, wherein the hanger is molded from plastic material.

12. The merchandise display system of claim 1, wherein the hanger is generally L-shaped.

13. The merchandise display system of claim 1, wherein the second end of the hanger is bent upward to form an obtuse angle between the second hanger end and the central hanger portion.

14. The merchandise display system of claim 1, wherein the first end of the hanger is bent to form an angle of about 90 degrees between the first hanger end and the central hanger portion.

15. The merchandise display system of claim 1, wherein the first end of the hanger is bent to form an acute angle between the first hanger end and the central hanger portion.

16. The merchandise display system of claim 1, wherein the first end of the hanger is bent to form an obtuse angle between the first hanger end and the central hanger portion.

17. The merchandise display system of claim 1, wherein the pocket member further comprises a second pocket formed thereon.

18. The merchandise display system of claim 1, wherein an intermediate portion of the pocket member comprises an elongated and hollow tube region adapted to receive the hanger therein when the pocket member hangs on the hanger.

19. The merchandise display system of claim 1, wherein the pocket is disposed on a first side and at a first end of the pocket member, the pocket member further comprising a second pocket formed on the first side and at a second end of the pocket member, the pocket member being adapted to be draped over and saddling the hanger when operably installed such that the pocket member becomes generally U-shaped and the pockets face opposite directions.

20. The merchandise display system of claim 19, wherein the pockets are each adapted to hold at least one sheet of paper.

21. The merchandise display system of claim 20, wherein the paper is rectangular shaped having the dimensions of about 8.5 inches by about 11 inches.

22. The merchandise display system of claim 20, wherein the paper is rectangular shaped having the dimensions of about 12 inches by about 12 inches.

23. The merchandise display system of claim 1, wherein the pocket is at least partly made from transparent material such that when an object is in the pocket, the object can be seen through the pocket.

24. The merchandise display system of claim 1, further comprising a second pocket formed on the pocket member, wherein the pockets are formed on opposite sides of the pocket member.

25. The merchandise display system of claim 1, further comprising two or more additional pockets formed on the pocket member.

26. The merchandise display system of claim 1, further comprising an attachment hook member extending from the base member, the attachment hook member being adapted to removably latch onto a display fixture;

27. The merchandise display system of claim 1, further comprising attachment hook members extending from one side of the base member, the attachment hook members being adapted to removably latch onto at least one type of standard display fixture.

28. The merchandise display system of claim 1, further comprising a tip cover adapted to fit over at least part of the second hanger end.

29. The merchandise display system of claim 1, further comprising a tip cover disposed over at least part of the first hanger end when the at least part of the first hanger end extends through and outside of the base member.

30. A product display system comprising, in combination:

an elongated base member including first and second base sections movably coupled together for extension and retraction relative to each other, at least one of said base sections having spaced apart holes formed therein along the base member;

attachment hooks extending from the base member, the attachment hooks being adapted to removably latch onto a display fixture to secure the base member to the display fixture;

a generally L-shaped hanger having a first end, a central portion, and a second end, the first hanger end extending transversely relative to the central hanger portion to form an included angle between the first hanger end and the central hanger portion between about 45 degrees and about 135 degrees, the first hanger end adapted to be removably inserted into at least one of the holes, such that the first hanger end can pivot while in the at least one hole, such that the hanger can pivot about the first hanger end relative to the base member, and such that the second hanger end traverses along an arc when the hanger pivots about the first hanger end; and a pocket member including a pocket formed thereon, the pocket member being adapted to hang on the hanger along at least part of the central hanger portion.

31. A product display system comprising, in combination:

a first elongated base member having a first plurality of substantially evenly spaced holes formed therein;

a second hollow elongated base member having a second plurality of substantially evenly spaced holes formed therein, wherein the first base member has an outside shape and dimensions such that the first base member can telescopically slide at least partially into the second base member, wherein the first plurality of holes is adapted to be aligned in registration with the second plurality of holes at two or more different positions;

a first attachment hook extending from the first base member;

a second attachment hook extending from the second base member, the attachment hooks being adapted to removably latch onto a display fixture;

a generally L-shaped hanger having a first end, a central portion and a second end, the first hanger end being bent relative to the central hanger portion to form an angle between the first hanger end and the central hanger portion between about 45 degrees and about 135 degrees;

the first hanger end adapted to be removably inserted into at least one of the second plurality of holes and into at least one of the first plurality of holes at the same time, such that the hanger prevents the first base member from sliding relative the second base member when the first hanger end is operably installed, such that the first hanger end can pivot while in the holes, such that the hanger can pivot about the first hanger end relative to the base members, and such that the second hanger end traverses along an arc when the hanger pivots about the first hanger end; and a pocket member comprising a pocket formed thereon, the pocket member being adapted to hang on the hanger along at least part of the central hanger portion.

* * * * *